US006436336B1

(12) United States Patent
Knudsen et al.

(10) Patent No.: US 6,436,336 B1
(45) Date of Patent: Aug. 20, 2002

(54) REPLACEABLE DRAIN ELECTROSLAG GUIDE

(75) Inventors: Bruce Alan Knudsen, Amsterdam; Robert John Zabala, Schenectady; Mark Gilbert Benz, Burnt Hills; William Thomas Carter, Jr., Galway, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,925

(22) Filed: Jun. 27, 2001

(51) Int. Cl.[7] ..... C21B 3/06

(52) U.S. Cl. ..... 266/201; 266/236; 222/593; 373/142

(58) Field of Search ..... 266/202, 200, 266/201, 236; 222/593; 373/142, 146, 156

(56) References Cited

U.S. PATENT DOCUMENTS

| | | | | |
|---|---|---|---|---|
| 4,631,013 A | | 12/1986 | Miller | |
| 5,310,165 A | | 5/1994 | Benz et al. | |
| 5,366,204 A | | 11/1994 | Gigliotti, Jr. et al. | |
| 5,809,057 A | | 9/1998 | Benz et al. | |
| 6,104,742 A | * | 8/2000 | Carter, Jr. et al. | 373/42 |
| 6,219,372 B1 | * | 4/2001 | Zabala et al. | 373/142 |

FOREIGN PATENT DOCUMENTS

EP 1113083 A2 * 4/2001

* cited by examiner

*Primary Examiner*—Scott Kastler
(74) *Attorney, Agent, or Firm*—Paul J. DiConza; Donald S. Ingraham

(57) ABSTRACT

A melt guide includes a base plate having internal cooling channels and a center aperture extending vertically therethrough. A unitary drain bushing is removably mounted in the aperture and is readily replaceable after wear thereof.

19 Claims, 2 Drawing Sheets

REPLACEABLE DRAIN ELECTROSLAG GUIDE

FEDERAL RESEARCH STATEMENT

The U.S. Government may have certain rights in this invention pursuant to contract number F33615-96-2-5262 awarded by DARPA.

BACKGROUND OF INVENTION

The present invention relates generally to electroslag refining, and, more specifically, to electroslag refining of superalloys.

Electroslag refining is a process used to melt and refine a wide range of alloys for removing various impurities therefrom. U.S. Pat. No. 5,160,532-Benz et al. discloses a basic electroslag refining apparatus for refining typical superalloys of nickel, cobalt, zirconium, titanium, or iron.

The initial, unrefined alloys are typically provided in the form of an ingot which has various defects or impurities which may be removed during the refining process to enhance metallurgical properties thereof, including grain size and microstructure for example.

In electroslag refining, the ingot is suspended inside a crucible and electrically powered. Slag is electrically heated inside the crucible by current passing between the electrode ingot and the crucible for melting the lower end of the ingot.

As the ingot melts a refining action takes place, with oxide inclusions in the ingot melt being exposed to the liquid slag and dissolved therein. Droplets of the ingot melt fall through the slag by gravity and are collected in a liquid melt pool at the bottom of the crucible, with the slag floating thereatop.

The refined melt is typically extracted from the crucible by an induction-heated, segmented, water-cooled copper guide tube. The guide tube is relatively complex for inductively heating the refined melt as it is drained by gravity therethrough for preventing solidification of the melt which would decrease its discharge or draining rate.

The stream of refined melt discharged from the crucible makes an ideal liquid metal source for many solidification processes including powder atomization, spray deposition, investment casting, melt-spinning, strip casting, and slab casting. In spray forming, the melt is atomized with a suitable atomizing gas and collected on a suitable workpiece or ingot. An atomizer ring is typically mounted directly below the guide tube for receiving the refined melt for atomization thereof.

Spray forming is typically effected at a substantially constant rate of melt delivery, and accordingly the guide tube must be precisely configured and operated to control the induction heating of the discharged melt, as well as the cooling of the guide tube.

At the completion of refining of an individual ingot, the refining process is terminated which causes plugging of the discharge orifice in the guide tube with solidified melt. The orifice is unplugged by physically removing or extracting the plug therefrom which causes wear of the soft copper drain orifice. Accumulation of wear in the orifice over one or more cycles of electroslag refining increases the size of the orifice and can adversely affect the desired flowrate of the refined melt therethrough.

Accordingly, the entire segmented guide tube must be disassembled from the crucible and replaced with new components including a properly sized drain orifice. This correspondingly increases the associated cost of electroslag refining and subsequent spray forming.

It is, therefore, desired to provide an electroslag refining apparatus having an improved discharge guide.

SUMMARY OF THE INVENTION

A melt guide includes a base plate having internal cooling channels and a center aperture extending vertically therethrough. A unitary drain bushing is removably mounted in the aperture and is readily replaceable after wear thereof.

BRIEF DESCRIPTION OF DRAWINGS

The invention, in accordance with preferred and exemplary embodiments, together with further objects and advantages thereof, is more particularly described in the following detailed description taken in conjunction with the accompanying drawings in which.

DETAILED DESCRIPTION

Figure 1:
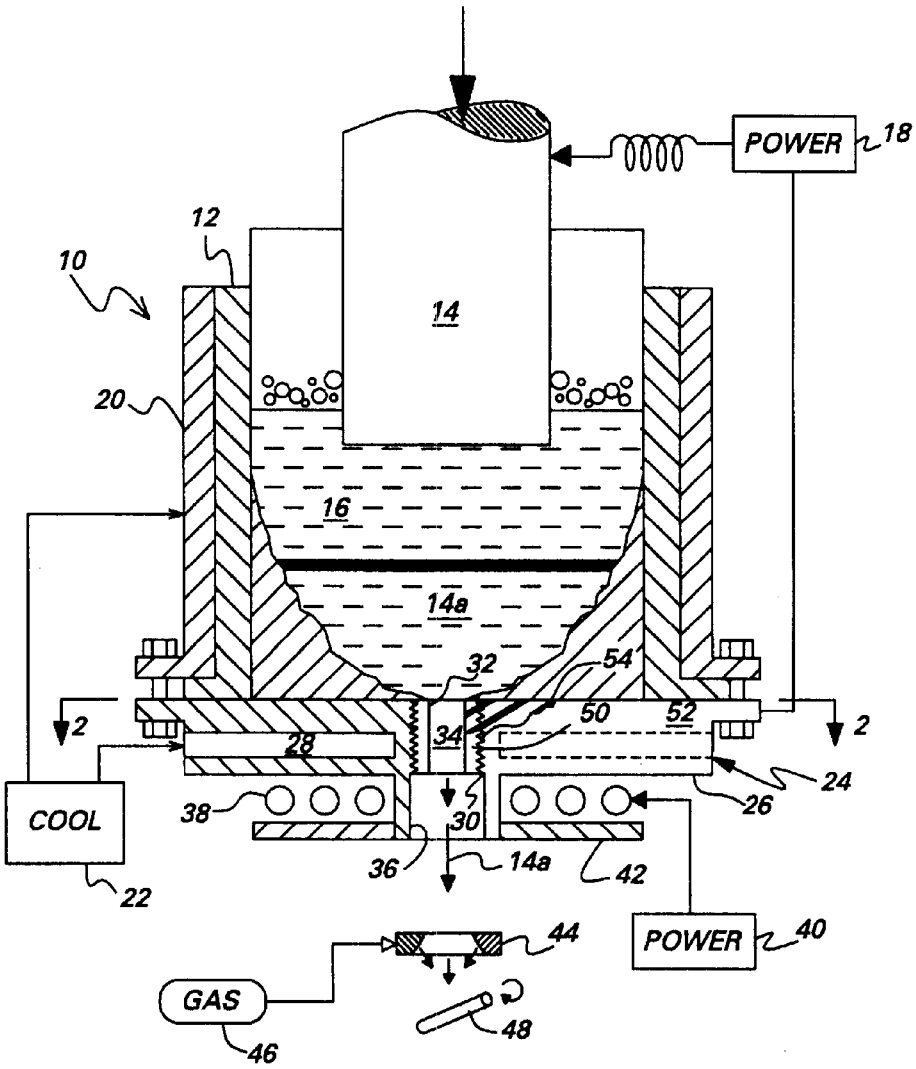
FIG. 1 is a schematic elevational view, partly in section, of an electroslag refining apparatus including a melt guide in accordance with an exemplary embodiment of the present invention.

Illustrated schematically in FIG. 1 is an electroslag refining apparatus 10 in accordance with a preferred and exemplary embodiment of the present invention. The apparatus includes a cylindrical crucible 12 in which is suspended an ingot 14 of a suitable alloy for undergoing electroslag refining. For example, the ingot may be formed from nickel or cobalt based superalloys which require refining and removal of impurities therein.

A suitable slag 16 is provided inside the crucible and may take any conventional composition for refining a specific material of the ingot.

Conventional means 18 are provided for heating and melting the tip of the ingot as it is fed downwardly into the crucible by any conventional feeding means. The heating means include a suitable electrical current power supply joined to the ingot and the crucible. Electrical current is carried through the ingot, which defines an electrode, and through the slag in liquid form to the crucible. In this way, the slag is resistively heated to a suitably high temperature to melt the bottom end of the ingot suspended therein.

Electroslag refining occurs at high temperature, and therefore the crucible is typically mounted inside a cooling jacket 20, and suitable means 22 are joined in flow communication with the jacket for circulating a coolant, such as water, therethrough during operation.

During electroslag refining, metal droplets melting from the bottom end of the ingot are exposed to the liquid slag 16 which dissolves oxide inclusions therein. The crucible 12 is typically formed of copper and is isolated from the refining process by a solidified skull of the slag which forms inside the crucible due to the cooling effect of the surrounding cooling jacket.

The refined ingot melt 14*a* collects in a pool or reservoir at the bottom of the crucible around which is also formed during operation a solidified skull of the refined melt due to the cooling effect of the surrounding jacket. In this way, the solid skull of refined melt protects the liquid melt from contamination by the surrounding copper crucible.

In order to extract the refined melt 14*a* from the bottom of the crucible, a melt guide 24 is suitably mounted to the bottom of the crucible for defining the bottom of the reservoir in which the refined melt is initially stored prior to draining by gravity through the melt guide. The melt guide includes a base plate 26 preferably formed of copper and sized to enclose the crucible bottom. For example, fastening bolts may be distributed around the rim of the base plate for attachment to a corresponding flange around the bottom of the water jacket 20.

Figure 2:
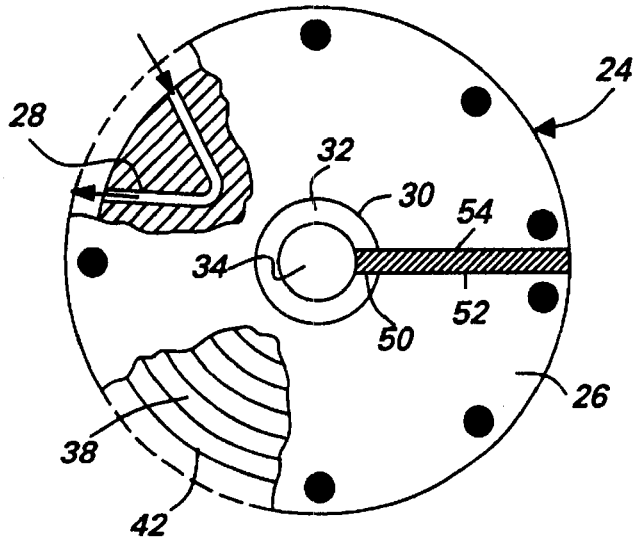
FIG. 2 is a partly sectional top view of the melt guide illustrated in FIG. 1 and taken along line 2—2.

The base plate preferably includes internal cooling channels 28 for circulating a coolant, such as water, therethrough. As shown in FIG. 2, the cooling channels may be drilled radially inwardly from the perimeter of the base plate and intersect each other in generally V-shaped channels distributed uniformly around the perimeter of the base plate. The conventional cooling means 22 described above may be operatively joined to the cooling channels in the base plate for circulating the coolant therethrough and removing heat during operation.

The base plate also includes a center aperture 30 extending vertically through the base plate from its top to bottom surfaces. And, a one-piece or unitary drain bushing 32 is removably mounted in the center aperture. The bushing or insert includes a center orifice or drain 34 extending vertically through the bushing for providing a flowpath for draining by gravity the refined melt 14*a* from the crucible.

A particular advantage of the drain bushing 32 is its simple tubular construction with a solid cylindrical wall devoid of any cooling passages therein. The bushing is formed of a suitable heat conducting material, such as copper, and preferably adjoins the aperture wall behind the cooling channels 28 surrounding the center aperture 30.

In this way, the bushing may directly contact the inner surface of the center aperture for providing a heat conduction path into the base plate in close proximity to the inner ends of the several cooling channels 28. The bushing itself is thusly cooled during operation by heat conduction laterally through the aperture 30 and into the cooling channels through which the water coolant is circulated.

The drain bushing 32 may be removably mounted in the center aperture 30 in any suitable manner which ensures its retention therein during the electroslag refining process. For example, the bushing may be brazed in the central aperture, or press fit therein in an interference fit.

Figure 3:
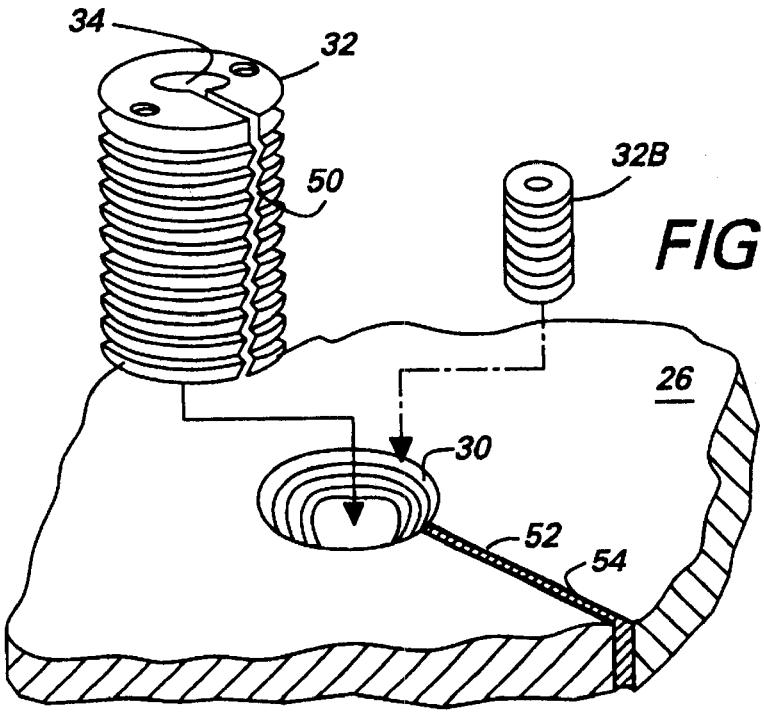
FIG. 3 is an exploded, isometric view of the removable drain bushing being assembled into the center aperture of the base plate illustrated in FIGS. 1 and 2 in accordance with an exemplary embodiment.

In the preferred embodiment illustrated in FIGS. 1 and 3 the center aperture 30 preferably includes internal screw threads, and the drain bushing 32 preferably includes complementary external screw threads engaging the internal threads. In this way, the threaded bushing 32 may be screwed into the threaded aperture 30 for assembly therein. And, the bushing may be removed from the base plate by being simply unscrewed therefrom.

As indicated above, electroslag refining of each ingot 14 terminates with a solidified plug of refined melt remaining in the drain 34. The plug is suitably extracted from the drain by being pulled therefrom for example, with each extraction causing some wear of the drain surface. When excessive wear accumulates in the drain 34, the insert 32 may be simply removed by being unscrewed from the base plate and replaced by a new insert which is simply screwed therein.

Any suitable driving features may be incorporated in the bushing for screwing and unscrewing thereof as required. For example, FIG. 3 illustrates two recesses in the top surface of the bushing in which a corresponding tool may be inserted for rotating the bushing into or out of the aperture.

As shown in FIG. 1, the base plate 26 preferably also includes an integral drain tube 36 extending downwardly from the bottom surface of the base plate, and coaxially aligned with the center aperture 30 for providing an extension thereof below the bushing. In this way, the bushing 32 may be relatively short in height and defines an upper drain through the base plate itself which is cooled by heat conduction through the aperture and into the cooling channels 28.

A radial temperature gradient will be effected during operation radially outwardly from the hot refined melt 14*a* being drained through the bushing to the relatively low temperature of the coolant circulating in the cooling channels. The bushing will expand under the heat of the refined melt and effect an interference fit with the center aperture for providing an effective heat conduction path for the cooling thereof.

Means including electrical coils 38 surround the drain tube 36 and are configured for induction heating the melt 14*a* inside the drain bushing. A suitable electrical power supply 40 is operatively joined to the induction heating coils 38 for providing electrical power thereto. And, the coils have a conventional configuration including hollow centers through which cooling water is circulated during operation.

In the preferred embodiment illustrated in FIG. 1, a shield 42 in the form of a flat disk is fixedly joined to the lower end of the drain tube for protecting the induction coils 38 from backsplash of the melt 14*a* being discharged through the drain bushing and tube. The shield may be formed of copper, like the drain tube and base plate, which are suitably joined together in an integral assembly.

As indicated above, the discharged melt 14*a* may be used for various processes, such as spray forming for example. Illustrated in FIG. 1 is a conventional atomizing ring 44 suitably mounted below the drain tube 36 and through which the refined melt passes under gravity force. A gas supply 46 is operatively joined to the atomizing ring and discharges a suitable atomizing gas through the ring for atomizing the refined melt 14*a* which is deposited atop a workpiece 48 of any suitable form.

The spray forming process effected by the atomizing ring 44 creates minute particles of the refined melt material which are liberated in all directions. The shield 42 is positioned between the induction coils and the atomizer for protecting the induction coils from backsplash of the refined melt.

A conventional cold-wall-induction guide is circumferentially segmented in many portions separated by insulated radial gaps therebetween. The radial gaps are provided for transferring the induction energy or field from the induction coils through the guide and into the refined melt for maintaining a suitable temperature thereof.

However, it has been discovered that the drain bushing may be circumferentially continuous without slots when formed of a suitable refractory material such as tungsten, molybdenum, or rhenium, for example. Such refractory metals may be inductively heated by the coils 38 which in turn heats the refined melt inside the drain. FIG. 3 illustrates the refractory bushing 32B as an option.

However, in the preferred embodiment illustrated in FIGS. 1–3, the drain bushing 32 is formed of copper for its heat conducting capability in the cooling thereof, and includes a single slot 50 severing the wall thereof axially and radially along the full length or span of the bushing.

Correspondingly, the base plate 26 includes a single slot 52 extending radially outwardly from the center aperture.

And, the bushing slot 50 is aligned radially with the plate slot 52 at the same circumferential position for defining a common slot extending radially outwardly from the drain 34 to the perimeter of the base plate.

The coextensive slots 50,52 are preferably electrically insulated, such as being filled by an electrical insulator 54, like silicone. The insulator is illustrated in part in FIGS. 1 and 3 for clarity of presentation, with FIG. 2 illustrating the complete filling of both slots 50,52 with the insulator in the preferred embodiment.

It has been discovered that the single slot 52 in the base plate 26 is sufficient for transmitting induction energy from the coils through the base plate and into the refined melt inside the drain bushing 32 during operation. The multiple slots previously used in conventional cold-wall-induction guides are no longer required, but may be used if desired for maximizing efficiency in transferring induction energy into the refined melt.

The single slot 52 substantially decreases the complexity of the base plate and permits the manufacture of a unitary or one-piece construction thereof, with the internal cooling channels being suitably formed therein.

Correspondingly, the unitary drain bushing 32 is a relatively simple tubular insert preferably having the single slot 50 extending through the wall thereof, which is also readily manufactured with simple manufacturing equipment. The bushing is assembled into the center aperture with the two slots 50,52 being aligned radially with each other, and then the insulator 54 may be inserted into the common slots 50,52 to complete the assembly.

In the preferred embodiment illustrated in FIG. 1, the base plate 26 is a flat circular disk of relatively simple construction, and the upper drain bushing 32 is sized in length to extend through the center aperture and terminate directly above the extension tube 36. In this way, the drain bushing is relatively short and effectively controls the discharge flow rate of the refined melt during operation, and is effectively cooled by conduction through the aperture in which it is seated.

Correspondingly, the shield 42 is spaced parallel from the flat base plate 26, and the induction heating coils 38 are disposed in a single plane axially therebetween and around the lower drain tube 36.

The resulting melt guide 24 is an assembly of simple components which may be readily manufactured and assembled together for reducing complexity of the entire apparatus, and correspondingly reducing cost thereof. And, the drain bushing 32 is readily removable and replaceable as it becomes worn during operation for further decreasing the complexity of the apparatus and the corresponding process of refining the ingot material and subsequently draining the refined melt from the crucible.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A melt guide for enclosing the bottom of an electroslag refining crucible containing a melt of electroslag refined metal, comprising:

a base plate sized to enclose said crucible bottom, and having internal channels for circulating a coolant therethrough, and a center aperture extending vertically; and a unitary drain bushing removably mounted in said aperture, and including a center drain extending vertically therethrough for draining said melt from said crucible, wherein said drain bushing is tubular with a solid cylindrical wall adjoining said aperture behind said cooling channels for cooling said bushing by conduction through said aperture;

wherein said base plate further includes an integral tube extending downwardly therefrom and coaxially aligned with said center aperture below said bushing.

2. A melt guide according to claim 1, further comprising means surrounding said tube for induction heating said melt inside said bushing.

3. A melt guide according to claim 2 further comprising a shield fixedly joined to the lower end of said tube.

4. A melt guide according to claim 3 wherein said center aperture 30 includes internal threads, and said bushing 32 further includes external threads engaging said internal threads for removably mounting said bushing in said base plate.

5. A melt guide according to claim 3 wherein said bushing includes a single slot severing said wall thereof axially and radially along the span thereof.

6. A melt guide according to claim 5 wherein said base plate includes a single slot extending radially outwardly from said center aperture, and said bushing slot is aligned radially therewith.

7. A melt guide according to claim 6 wherein said bushing slot and said plate slot are filled with an electrical insulator.

8. A melt guide according to claim 3 wherein said base plate is flat, and said bushing is sized in length to extend through said center aperture thereof.

9. A melt guide according to claim 8 wherein said shield is spaced parallel from said base plate, and said induction heating means include a plurality of electrical coils disposed therebetween around said tube.

10. A melt guide for enclosing the bottom of an electroslag refining crucible containing a melt of electroslag refined metal, comprising:

a flat base plate sized to enclose said crucible bottom, and having internal channels for circulating a coolant therethrough, and a center aperture extending vertically therethrough;

a unitary drain bushing removably mounted in said aperture, and including a center drain extending vertically therethrough for draining said melt from said crucible;

an integral tube extending downwardly from said base plate and coaxially aligned with said center aperture below said bushing; and a shield fixedly joined to the lower end of said tube.

11. A melt guide according to claim 10 further comprising means surrounding said tube between said base plate and shield for induction heating said melt inside said bushing.

12. A melt guide according to claim 11 wherein said bushing is sized in length to extend through said center aperture of said base plate and terminate above said tube.

13. A melt guide according to claim 12 wherein said drain bushing is tubular with a solid cylindrical wall adjoining said aperture behind said cooling channels for cooling said bushing by conduction through said aperture.

14. A melt guide according to claim 13 wherein said bushing includes a single slot severing said wall thereof axially and radially along the span thereof.

15. A melt guide according to claim 14 wherein said base plate includes a single slot extending radially outwardly from said center aperture, and said bushing slot is aligned radially therewith.

16. A melt guide according to claim 15 wherein said bushing slot and said plate slot are filled with an electrical insulator.

17. A melt guide according to claim 15 wherein said center aperture includes internal threads, and said bushing further includes external threads engaging said internal threads for removably mounting said bushing in said base plate.

18. A melt guide according to claim 15 wherein said shield is spaced parallel from said base plate, and said induction heating means include a plurality of electrical coils disposed therebetween around said tube.

19. A melt guide according to claim 13 wherein said drain bushing is tubular with a continuous cylindrical wall formed of refractory material.

* * * * *